United States Patent [19]

Frazier et al.

[11] 4,423,845

[45] Jan. 3, 1984

[54] REFINER PLATES

[75] Inventors: William C. Frazier; Robert S. Charlton, both of British Columbia, Canada

[73] Assignee: MacMillan Bloedel Limited, Vancouver, Canada

[21] Appl. No.: 262,810

[22] Filed: May 12, 1981

Related U.S. Application Data

[63] Continuation-in-part of Ser. No. 95,612, Nov. 19, 1979, abandoned.

[30] Foreign Application Priority Data

Oct. 4, 1979 [GB] United Kingdom ..... 7934555

[51] Int. Cl.[3] ..... B02C 7/12

[52] U.S. Cl. ..... 241/261.3; 241/298

[58] Field of Search ..... 241/296, 298, 197, 261.2, 241/261.3

[56] References Cited

U.S. PATENT DOCUMENTS

| | | | |
|---|---|---|---|
| 992,000 | 5/1911 | Kihlgren | 241/261.2 |
| 2,888,212 | 5/1959 | Albert et al. . | |
| 3,149,792 | 9/1964 | Textor . | |
| 3,462,089 | 8/1969 | Whitlow | 241/296 |
| 4,023,739 | 5/1977 | Lampe et al. | 241/296 |
| 4,039,154 | 8/1977 | Peterson | 241/296 X |
| 4,061,283 | 12/1977 | Kahmann | 241/296 X |
| 4,166,584 | 9/1979 | Asplund | 241/298 X |

*Primary Examiner*—Mark Rosenbaum

*Attorney, Agent, or Firm*—Schuyler, Banner, Birch, McKie & Beckett

[57] ABSTRACT

An improvement in refiner discs for mechanical pulping of wood and other material is disclosed which increases wood pulp production. The improvement has at least one refiner plate set mounted on a disc to form a pair of opposing refiner plate sets. The one refiner plate set has a series of hard spots placed at different radial distances on the surface. In one process of manufacturing the plate set, a series of locations are hardened, preferably by spot welding or spot hardening on at least one raised portion of the plate set.

18 Claims, 6 Drawing Figures

REFINER PLATES

This is a continuation-in-part of application Ser. No. 95,612 filed Nov. 19, 1979 now abandoned.

This invention relates to mechanical refining of cellulosic or lignocellulosic material. More specifically, this invention relates to an improvement in refiner plates which increases the production rate of a disc refiner operating at a pulp consistency of at least about 10%.

Disc refiners used in the production of pulp comprise two co-axial discs set at close proximity to each other. The discs are arranged to rotate with respect to each other. Either one disc is rotated whilst the other disc remains stationary, or alternatively the two discs are driven to rotate in opposite directions. In most disc refiners the discs are essentially planar. However, other configurations are possible. For example, an inner planar region may be combined with an outer conical region. Throughout this specification reference is made to opposing refiner discs; however, these need not be strictly planar but may be of any configuration adapted for use in a disc refiner. The material, which may be in the form of chips, sawdust or pulp, generally mixed with water, is fed into the eye or central zone of the refiner, and is then carried outwards between the two discs partly by centrifugal force and to some extent by the force of steam generated through the mechanical work done on the moist wood material. The refiner discs are generally faced with opposing circular ring shaped plate sets attached to the discs. The plate sets are replaceable because they wear down and must be replaced after a period of use. Each ring shaped plate set is usually equipped with numerous raised portions, often referred to as bars or ridges, arranged in a pattern, sometimes radially, sometimes in bands at different angles, sometimes in curved lines or in other patterns. The material being refined passes between the raised pattern on opposing plate sets and as a result of a complex system of shear forces set up between these raised portions, the material is disintegrated. If wood chips are being refined, pulp fibers are produced. If pulp fibers are being further refined, the individual fibers may be softened, fibrillated and shortened in a manner suitable for paper making.

To facilitate handling, a circular ring shaped plate set is generally made up of a number of circular ring sector plates which when bolted to the disc form a circular ring plate set. In one commercially available refiner, twelve circular ring sector plates are bolted side by side to a disc to form a circular ring shaped plate set. In other refiners the number, shape and arrangement of plates bolted to a disc to form a refiner plate set may be varied. Throughout the present disclosure the term refiner plate set is used to denote the complete facing plate set attached to a refiner disc, irrespective of the number of plates required to make that facing plate set, and irrespective of the configuration of the discs.

The quality of pulp and the output of pulp produced from any one refiner depends upon, amongst other things, the amount of refining energy applied by the opposing discs. To maintain a consistent high quality, the energy applied to each ton of pulp passing through the refiner should be kept at a substantially constant and adequately high level. The amount of energy that can be applied to the refiner depends in the first place on the horse-power rating of the motors driving the discs, and secondly on the axial force applied to push the two refiner discs together. However, it is important that this axial force should generally be kept below the force required to bring the plate sets mounted on the rotating opposing discs into contact with each other. There should be a layer of material separating the opposing plate sets, otherwise if they clash, frictional forces are set up which may damage the plate sets beyong use.

Disc refiners are commonly designed with a motor capacity of 10 horsepower per square inch of active plate surface area, that is the area of the interface formed between opposing plate sets in the refining zone where the faces of the opposing plate sets are approximately parallel to each other. In some instances it is found that the power consumed in refining wood chips or pulp is less than the motor capacity. For example in the second stage of thermomechanical pulping the power consumed may be as low as 7 horsepower per square inch of active plate set area. Thus, either the production rate of pulp is reduced in order to maintain the required level of refining energy for each ton of pulp which results in a low production capacity, or alternatively there is a reduction in the quality of pulp produced.

It is an object of the present invention to provide refiner plate sets which can process material to pulp at a substantially constant level of refining energy for each ton of pulp from one pair of opposing plate sets to the next. It is a further object of the invention to maximize the horsepower utilized from refiner motors in refining material to pulp between opposing plate sets in a disc refiner, particularly when refining a pulp stock having a consistency of at least about 10%.

It has been observed that after a pair of opposing refiner plate sets have been operating for a period of time, a series of concentric circular or circumferential grooves and ridges may develop on the face of one plate set with corresponding circumferential ridges and grooves on the face of the opposing plate set. The positioning of the circumferential grooves and ridges appears random, and the extent and intensity to which they occur vary from one plate set to another. The presence of such grooves and ridges has been found to be beneficial in the processing of mechanical pulp because where the grooves and ridges are more pronounced the refiner can be loaded with higher axial closing force, increasing the horsepower consumed in the refiner, and therefore increasing the productivity of the refiner. It has been further found that by arranging a series of hard or hardened spots at predetermined positions on one or both of the plate sets, the pattern of grooves and ridges which develops can be predetermined. Each hard spot gives rise to a circular or circumferential groove in the opposing plate set, with a corresponding circular or circumferential ridge on the plate set containing the hard spot, the ridge being coincident with the hard spot.

The present invention provides a refiner plate set for mounting on a disc to form one of a pair of refiner plate sets with opposing surfaces, the plate set having a series of hard spots located at different radial distances along the surface. In a preferred embodiment, the refiner plate set is formed of a plurality of circular ring sector plates mounted on the disc to form a circular ring. In another embodiment a series of raised portions or bars is provided on the surface, and the series of hard spots are located on at least one of the raised portions or bars. In one embodiment the hard spots are formed by spot welding and in another embodiment the hard spots are formed by spot hardening. In yet a further embodiment the hard spots are formed of inserts of a material harder than that from which the plate set is made. One example of such a material is sintered tungsten carbide.

The present invention also provides in a pair of refiner plate sets, each plate set mounted on a disc, the pair of plate sets positioned on a common axis with surfaces facing each other, the improvement of a series of hard spots placed at different radial distances from the axis, on at least one of the surfaces of the pair of plate sets.

The present invention also provides a process of manufacturing a refiner plate set comprising the steps of forming a refiner plate set having a plurality of raised portions on one surface, and hardening at a series of locations to form hard spots on at least one of the raised portions, the series of locations being at different radial distances from a common axis. In another embodiment the process includes forming the plate set from a plurality of circular ring sector plates, the hard spots being located on one of the circular ring sector plates.

In drawings which illustrate the embodiments of the invention:

Figure 3:
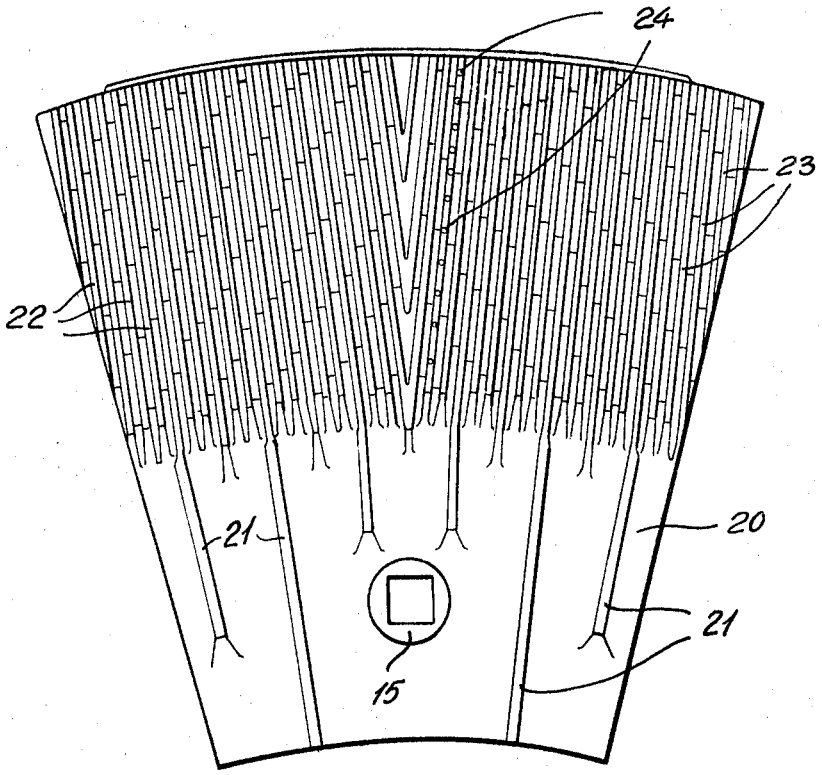
FIG. 3 is a front elevational view of one circular ring sector plate of a refiner plate set showing one embodiment of the present invention with hard spots along one radial bar.
Figure 5:
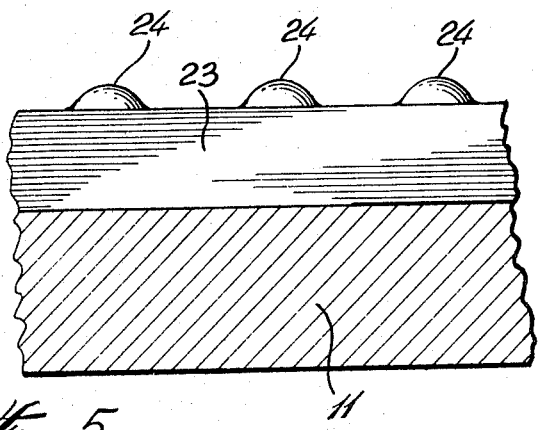

FIG. 5 shown on the third sheet of drawings, is a partial sectional view through the circular ring sector plate of FIG. 3 showing hard spots along one radial bar.

Figure 6:
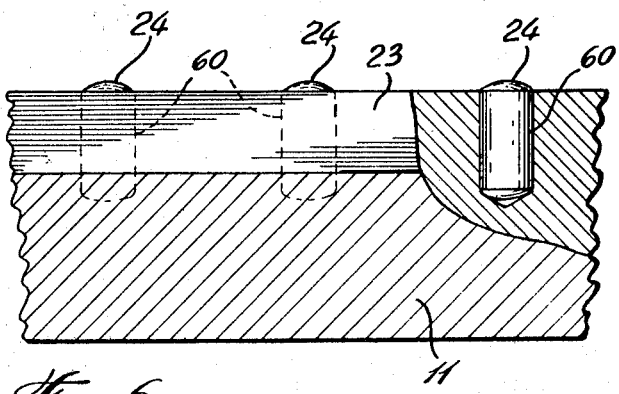

FIG. 6 shown on the fourth sheet of drawinge is a partial sectional view through the circular ring sector plate of FIG. 3 showing inserts for the hard spots along the radial bar.

Figure 1:
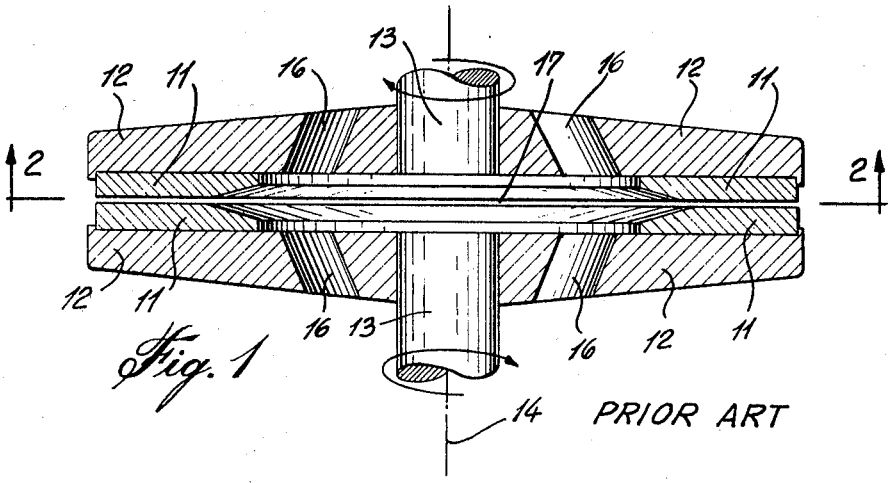
Fig. 1 PRIOR ART
FIG. 1 is an axial cross sectional view of a pair of refiner plate sets as known in the prior art.
Figure 2:
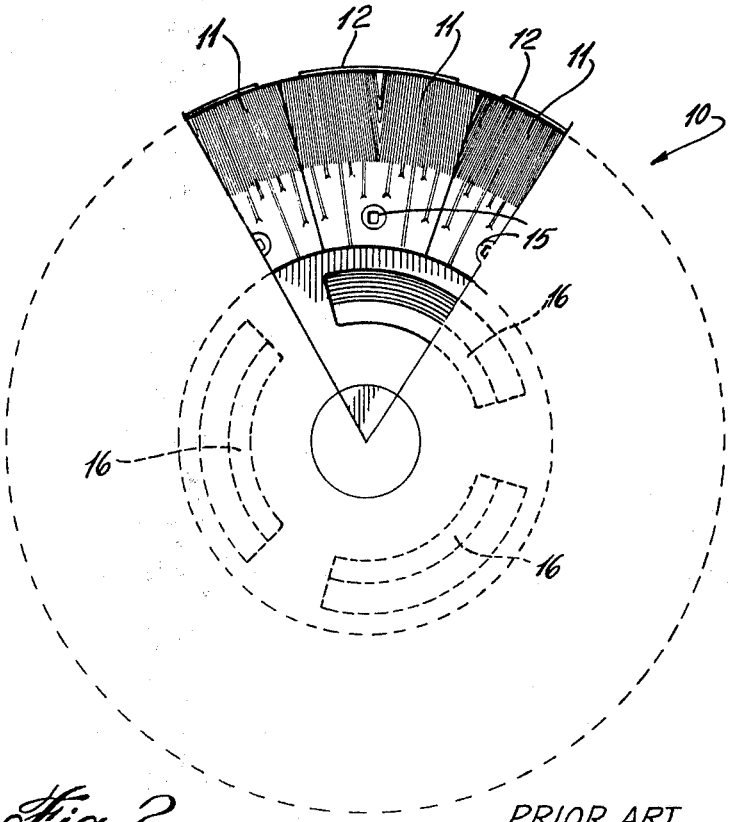
Fig. 2 PRIOR ART
FIG. 2 is an elevational view at line 2—2 of FIG. 1.

Referring to the drawings, FIG. 1 shows a pair of refiner plate sets 10 as known in the prior art. Each plate set 10 forms an annulus or circular ring and comprises a plurality of circular ring sector plates 11 which are attached to a backing disc 12. The surfaces of the sector plates 11 in one plate set 10 oppose the surfaces in the sector plates 11 of the other plate set 10. Both discs 12 are mounted on counter rotating shafts 13 rotating on a common axis 14. FIG. 2 illustrates the surface of one plate set 10 showing the individual circular ring sector plates 11 each attached to the backing disc 12 by bolts 15. Slots 16 in the backing disc 12 provide inlets for the material to be processed which is fed into a central zone 17 between the two backing discs 12. The material, which is generally wood chips, sawdust or pulp mixed with water, is fed to the central zone 17 and then passes radially outwards between opposing surfaces of the plate sets 10. The opposing plate sets 10 break down the chips or sawdust into pulp. The action effects softening, fibrillation and shortening of individual pulp fibers.

One embodiment may be seen in FIG. 2 and more clearly in FIG. 3 wherein a circular ring sector plate 11 has two breaking or pulping zones, the inlet zone 20 has a series of raised portions in the form of radial breaker bars 21 spaced apart and a refining zone 22 which has a series of raised portions in the form of radial bars 23 spaced close together. In some plate designs the number and the fineness of the bars 23 in the refining zone 22 increases towards the outer periphery. Whereas the pattern of the raised portion on the sector plate 11 is shown in the form of radial bars, many different patterns are used. Some designs have curved bars, or straight bars at an angle. In some cases the bars are in wave lines, in other cases in circular bands at different angles. The pattern of the raised portions does not form part of the present invention.

Figure 4:
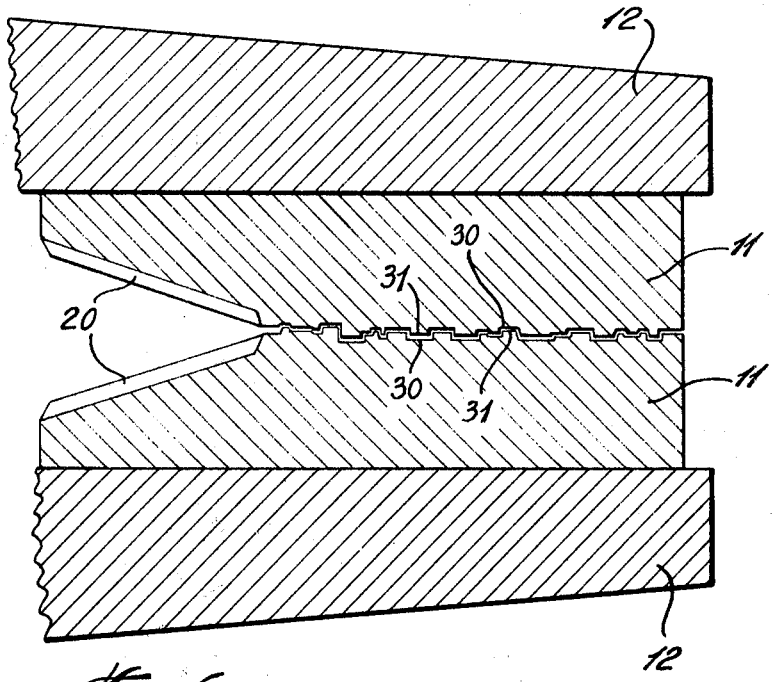
FIG. 4 is a partial axial cross sectional view through two opposing refiner plate sets showing opposing circumferential ridges and grooves.

When planar refiner plate sets are first manufactured, each circular ring sector plate 11 has a substantially flat face. When these sector plates 11 are bolted onto backing discs 12 to form plate sets 10, the flat surfaces of opposing plate sets are approximately coplanar, with a slight taper so that the gap between the opposing plate sets narrows slightly towards the outer periphery. It is often observed that with progressive use, concentric circumferential grooves 30 and ridges 31 as shown in FIG. 4 develop in the refining zone 22 of the plate set 10, and matched concentric circumferential ridges 31 and grooves 30 are formed in the opposing plate set 10. A circumferential groove 30 in one plate set 10 corresponds exactly with a circumferential ridge 31 on the opposing plate set 10. Thus what starts as a smooth thin wedged shape interface between the two opposing plate sets 10 develops into a markedly tortuous interface and the wood fibers as they pass out to the periphery of the pair of plate sets must pass through this tortuous interface.

FIG. 3 shows a circular ring sector plate 11 which has not been used and, therefore, has no circumferential grooves 30 or ridges 31 in the refining zone 22. A series of hard spots 24 each illustrated as a small circle on the drawing, is located on one of the radial bars 23. The spacing between these spots 24 is such that when the pair of opposing plate sets 10 rotate relative to each other, each individual spot 24 rotates to form a groove 30 in the opposing plate set 10 which leaves a corresponding ridge 31 on the plate set 10 attached to the backing disc 12 which carries the sector plate 11 having the hard spots 24. Thus, as the plate sets 10 wear, the hard spots 24 form a pattern of concentric ridges 31 on the surface of one refiner plate set 10 and concentric grooves 30 on the surface of the other refiner plate set 10, creating a tortuous path through which the pulp fibers must pass. Matched concentric grooves and ridges are formed when opposing plate sets grind against each other, that is when the plates clash as may happen occasionally during the operation of a refiner. In some instances it may be desirable to clash the plate sets 10 together intentionally a few times so that the ridges 31 and grooves 30 start to form on the surfaces of the opposing plate sets 10. This pattern of grooves 30 and ridges 31 greatly increases the power consumption of the refiner and allows more of the available horsepower provided by the refiner motors to be used without the opposing refiner plate sets touching. For example, in refining wood chips in a Bauer 489 atmospheric refiner, the initial energy consumption was only about 7,500 horsepower, but when the ridges and grooves had fully developed from the hard spots, this increased to 9,500 horsepower, the highest figure ever achieved with that particular refiner.

FIG. 5 illustrates a radial bar 23 on a sector plate 11 with a plurality of hard spots 24 in the form of slightly raised bumps, or arc welded beads which have been added by spot welding. The spots 24 are shown all on one radial bar 23 but may be on different bars 23, the important feature being that each spot 24 is positioned at a different radius from the axis 14. In one embodiment the segment is cast from a high chromium content white cast iron and the spots are arc welded beads, spot welded with a hard facing electrode.

In another embodiment, of the invention, the hard spots 24 are created by spot hardening. This process involves localized melting of the material to be hardened, which may be induced by such methods as tungsten inert gas arcing, spot resistance heating or spot induction heating.

In another embodiment, the plate set is formed from a metal capable of being hardened by the application of heat, and the hard spots are formed by the application of heat.

FIG. 6 illustrates another embodiment of the invention wherein each hard spot 24 in the radial bar 23 is an insert 60 formed of a material harder than the material from which the sector plate 11 is made, and has preferably a slightly raised surface above the level of the radial bar 23 of the sector plate 11. In a preferred embodiment, this insert 60 is formed from a sintered metal carbide.

Although the drawings illustrate a series of hard spots on only one circular ring sector plate, the concept could be applied by placing hard spots on more than one sector plate in a plate set provided the spots were arranged at different radial distances from the common axis. Furthermore, hard spots may be arranged on both opposing surfaces of plate sets provided opposing spots were not directly opposite each other, but are arranged so that a hard spot on the surface of one plate set forms a groove in the surface of the opposing plate set.

The drawings illustrate a refiner plate set formed of circular ring sector plates. It will be apparent that in a small refiner, the plate set may be a single circular ring, and in a large refiner two or more concentric rings may be provided each ring divided into circular ring sectors. In other refiner plate sets, individual plates may be trapezoidal or triangular in shape and when assembled and mounted on a disc, form approximately a ring shape but may have straight edges rather than curved edges. The refiner plate sets may be plane or of some other configuration. The term circular ring sector plates includes plane, partially plane, or other configuration which may be used in a disc refiner.

Various changes may be made to the application of the hard spots to form a predetermined pattern of circumferential grooves and ridges. If spot welding is used for the application of spots, they may conveniently be applied to one refiner plate set before installation on the refiner, on the plate set after installation in the refiner, or at any time during the life of the plate set. Different shapes or sizes of individual plates to make up a refiner plate set may require different numbers of hard spots. The scope of the present invention is limited only by the following claims.

The embodiments of the invention in which an exclusive property or privilege is claimed are defined as follows:

1. In a pair of refiner plate sets, each plate set mounted on a disc, the pair of plate sets positioned on a common axis with opposing surfaces facing each other, the improvement of a series of hard spots placed at different radial distances from the axis on at least one of the surfaces of the pair of plate sets.

2. The pair of refiner plate sets according to claim 1 wherein a series of raised portions are provided on the surface, and the series of hard spots are located on at least one of the raised portions.

3. The pair of refiner plate sets according to claim 2 wherein the series of hard spots are located in line on at least one of the raised portions.

4. The pair of refiner plate sets according to claim 1 wherein a series of bars are provided on the surface, and the series of hard spots are located on at least one of the bars.

5. The pair of refiner plate sets according to claim 1 wherein a plurality of circular ring sector plates are mounted on the disc to form a circular ring, each circular ring sector plate having a series of radial bars on the surface, and wherein the series of hard spots are located in line on one radial bar of one circular ring sector plate.

6. The pair of refiner plate sets according to claim 1, 2 or 5 wherein the disc is a planar disc.

7. The pair of refiner plate sets according to any of claims 1, 2 or 5 wherein the hard spots are formed by spot welding.

8. The pair of refiner plate sets according to any of claims 1, 2 or 5 wherein the hard spots are formed by spot hardening.

9. The pair of refiner plate sets according to any of claims 1, 2 or 5 wherein the hard spots are formed of inserts made of a material harder than the material from which the plate is made.

10. The pair of refiner plate sets according to any of claims 1, 2 or 5 wherein the hard spots are formed of inserts made of sintered tungsten carbide.

11. The pair of refiner plate sets according to claim 1, 2 or 5 wherein the plate sets are formed from a metal capable of being hardened by the application of heat, and the hard spots are formed by the application of heat.

12. The pair of refiner plate sets according to any of claims 1, 2 or 5 wherein the plate sets are formed from high chromium content white cast iron and the hard spots are formed by spot welding with a welding rod.

13. The pair of refiner plate sets according to any of claims 1, 2 or 5 wherein each of the hard spots has a raised surface.

14. The pair of refiner plate sets according to claim 1 wherein the series of hard spots result in the formation of a series of circumferential ridges in the surface of the plate set mounted on one disc and the circumferential ridges on the one disc result in the formation of a corresponding series of circumferential grooves in the surface of the plate set mounted on the opposing disc.

15. The pair of refiner plate sets according to claim 14 wherein the series of hard spots are located on at least one raised portion on one circular ring sector.

16. The pair of refiner plate sets according to claim 1 wherein each plate set includes a plurality of circular ring sector plates mounted in a circular ring on the disc.

17. A refiner for refining wood or wood pulp comprising, a pair of co-axially mounted discs, means for rotating at least one of the pair of discs to produce relative movement between the pair of discs, a pair of refiner plate sets, one plate set mounted on each of the pair of discs, the pair of plate sets having opposing surfaces, the opposing surfaces of the pair of plate sets having a series of raised portions, and a series of hard spots placed at different radial distances on the opposing surface of at least one of the raised portions on at least one of the pair of refiner plate sets.

18. The refiner according to claim 17 wherein the pair of discs are planar discs.

* * * * *